US005143145A

United States Patent [19]

Vatant et al.

[11] Patent Number: 5,143,145

[45] Date of Patent: Sep. 1, 1992

[54] MOULD FOR PRESSURE CASTING FLAT METAL PRODUCTS SUCH AS SLABS

[75] Inventors: Robert A. Vatant, Saint-Chamond; Michel F. Courbier, Le Breuil; Jean-Pierre L. Chalencon, Saint-Chamond, all of France

[73] Assignees: Creusot-Loire Industrie, Puteaux; Clecim, Cergy Pontoise, both of France

[21] Appl. No.: 720,778

[22] PCT Filed: Jan. 12, 1990

[86] PCT No.: PCT/FR90/00026

§ 371 Date: Sep. 10, 1991

§ 102(e) Date: Sep. 10, 1991

[87] PCT Pub. No.: WO90/07995

PCT Pub. Date: Jul. 26, 1990

[30] Foreign Application Priority Data

Jan. 16, 1989 [FR] France ..... 89 00453

[51] Int. Cl.[5] ..... B22D 18/04

[52] U.S. Cl. ..... 164/306; 164/339; 164/342; 164/348; 249/80; 249/134; 249/161

[58] Field of Search ..... 164/306, 309, 348, 339, 164/342, 119, 137; 249/80, 134, 161

[56] References Cited

U.S. PATENT DOCUMENTS 3,434,528 3/1969 McGeeney .
3,590,904 7/1971 Woodburn, Jr. .
3,646,991 3/1972 Jeffreys ..... 164/137 X
3,701,377 10/1972 Fisher ..... 164/119 X
3,888,453 6/1975 Jeffreys .
4,669,524 6/1987 Nelson ..... 164/137

FOREIGN PATENT DOCUMENTS 1433963 10/1968 Fed. Rep. of Germany ..... 164/137
49077 9/1965 Luxembourg .
1151401 5/1969 United Kingdom .

*Primary Examiner*—J. Reed Batten, Jr.
*Attorney, Agent, or Firm*—Cushman, Darby & Cushman

[57] ABSTRACT

The frame of a mould comprises at least one rigid transverse structure element disposed in a zone which is substantially distant from the ends of the frame. The transverse element comprises two end parts between which are disposed support beams of the lateral moulding walls. Jacks each fixed on an end bearing part of the structure element are connected via their movable rod to the beam in zones which are distant from the longitudinal ends of the beam. The jacks make it possible to achieve both the displacement of the walls between their opening and closing positions and the clamping of the mould. Restriction of the clamping stresses is provided by the structure element. The bending moment of the beams remains low since the points of application of the stresses on the beams are distant from the ends of these beams and chosen as a function of the clamping conditions of the mould.

19 Claims, 6 Drawing Sheets

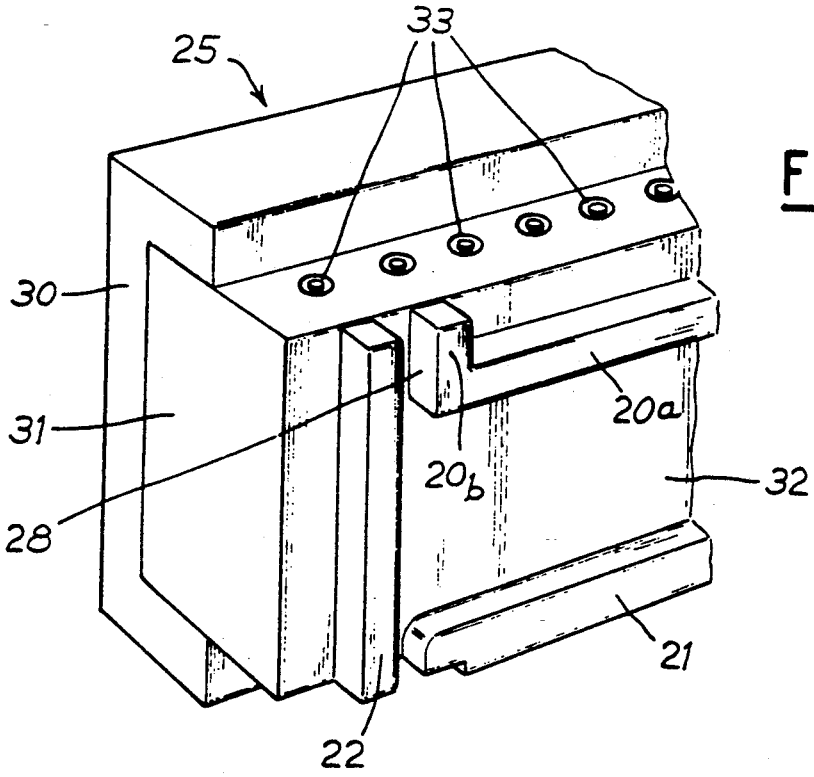
FIG.2
FIG.7
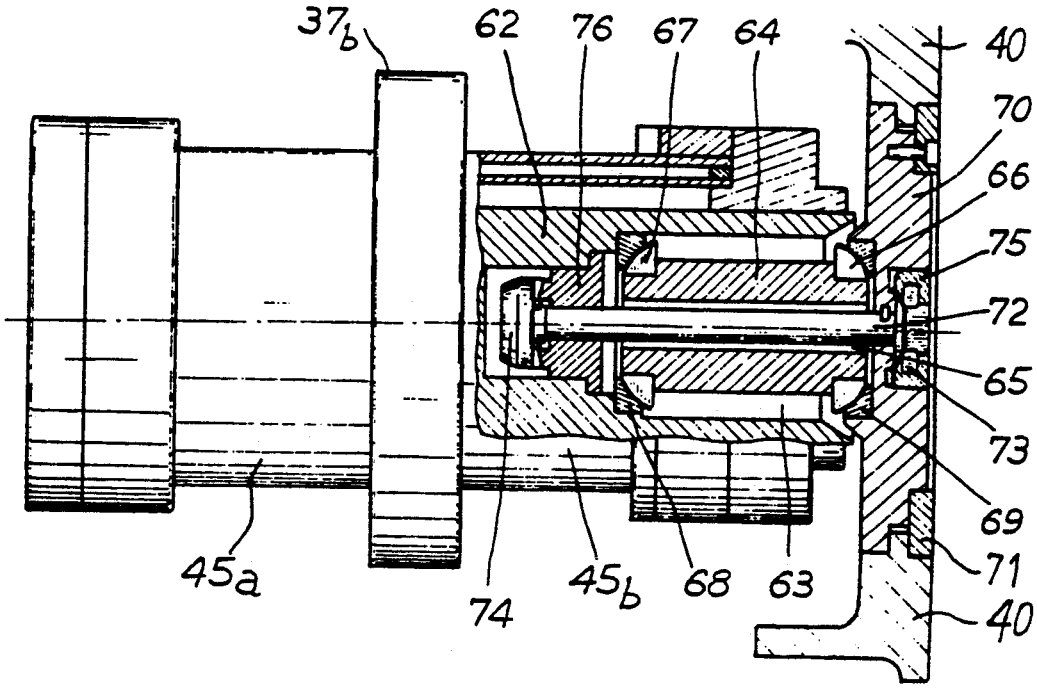

FIG.4
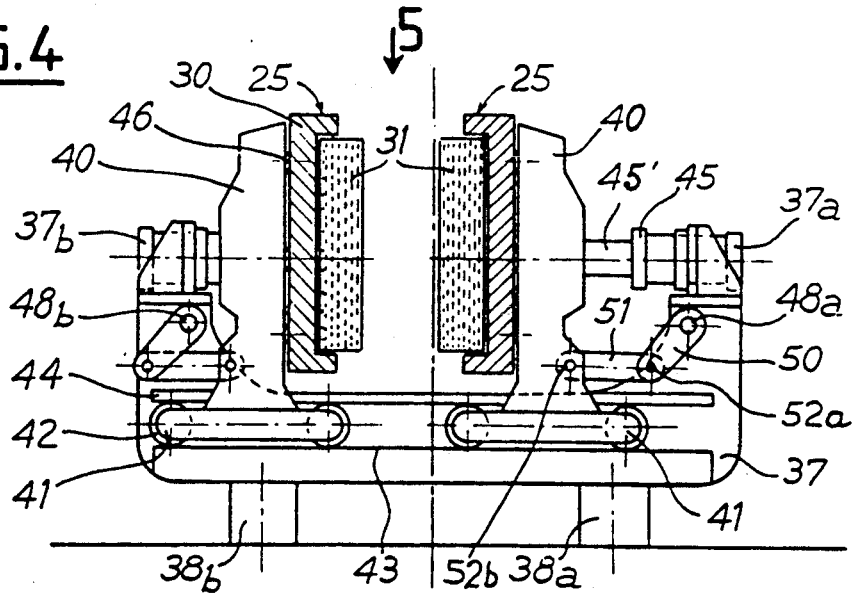
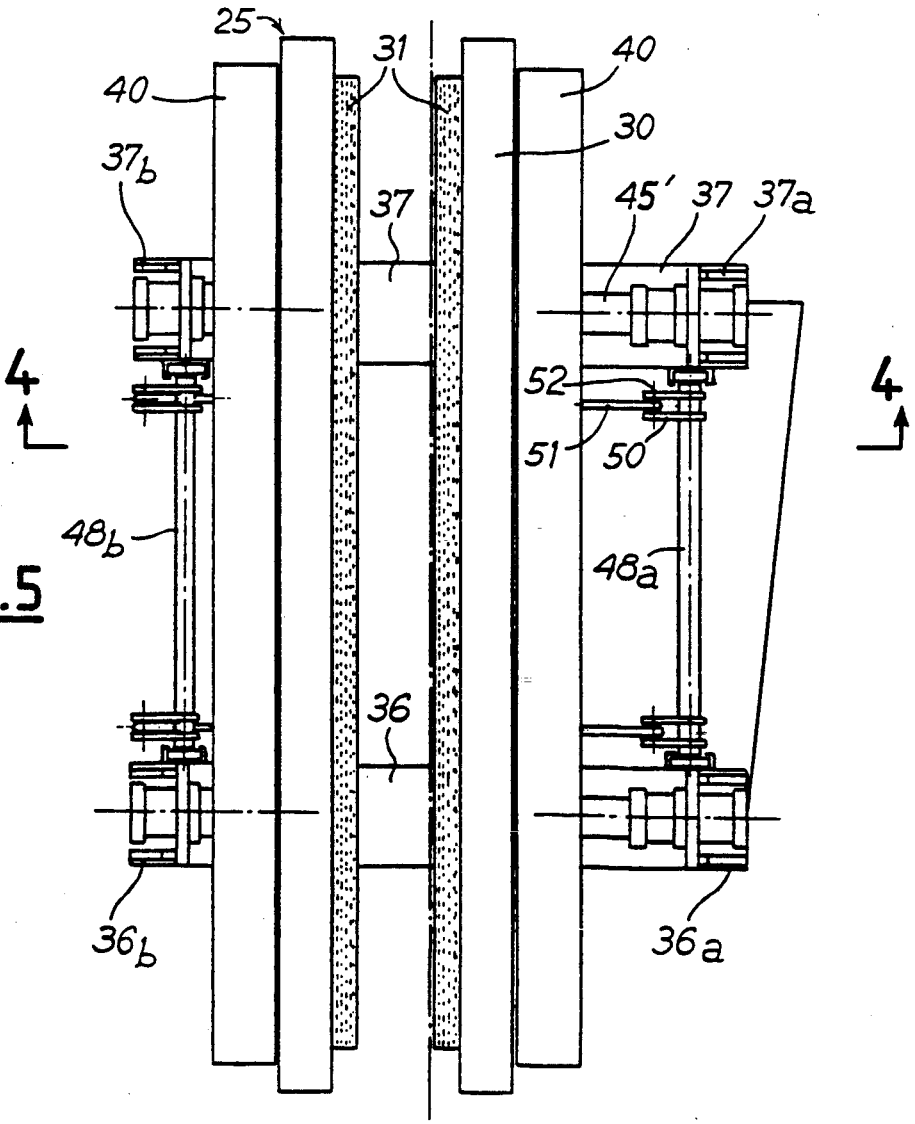
FIG.5

MOULD FOR PRESSURE CASTING FLAT METAL PRODUCTS SUCH AS SLABS

BACKGROUND OF THE INVENTION

The invention relates to a mould for pressure casting flat metal products of great thickness and considerable length such as steel slabs intended to be transformed into a sheet by rolling.

A casting method which consists in introducing a ladle containing the metal to be cast inside a vessel which is then closed by a cover applied in a leaktight manner to the upper edge of the vessel has been known and used for a long time. The cover of the vessel carries a tube in refractory material, the lower part of which is immersed in the metal filling the ladle and the upper part of which communicates with an opening which passes through the cover of the vessel equipped with means for connecting to a slide spout for casting the metal in a mould.

The assembly consisting of the vessel containing the ladle and equipped with its closing cover can be brought into a casting position beneath a mould comprising a filling spout in its lower part. The spout for filling the mould is caused to coincide and to come into leaktight contact with the device for connecting the cover to the ladle, then compressed air is conveyed inside the vessel so as to cause the metal to rise inside the refractory tube, then inside the mould, until the latter is completely filled.

By regulating the pressure of the gas conveyed in the ladle, the conditions for casting the metal and filling the mould are perfectly controlled, which makes it possible to obtain castings of a very satisfactory and uniform quality.

This pressure-casting method, described, for example, in patents U.S. Pat. No. 3,888,453 and U.S. Pat. No. 3,590,904, may be applied not only to the production of shaped pieces, but also to the casting of semi-manufactured products such as slabs, blooms, billets and tube rounds.

In the case of slabs, that is to say of flat steel products of great length and considerable thickness, it being possible for this thickness to be between, for example, 60 and 400 mm or more, use is made of moulds of very large dimensions which make it possible to cast slabs whose length may be of the order of 10 m or more and whose width may reach 3 m or more.

In certain cases, this casting method may advantageously replace the method for continuous casting of slabs, according to the nature of the grades to be cast, the tonnages to be produced and the size of the products both in terms of their thickness and their width.

The moulds used for the pressure casting of slabs comprise a support and tilting frame mounted so as to pivot about a horizontal axis so that it may be inclined very slightly, relative to the horizontal plane, before commencing a casting operation. This pivoting of the frame makes it possible to connect the spout for filling the mould to the exit opening of the cover of the vessel brought into the casting position beneath the mould and makes it possible to control the flow of steel over the lower spacer.

The mould principally comprises two lateral walls of large dimensions disposed parallel and opposite one another, the inner faces which are lined with graphite blocks of which form the surfaces of the mould which come into contact with the molten metal in order to delimit the two large faces of the slab.

The lateral walls are mounted on the frame so as to be movable in the direction perpendicular to their moulding faces, that is to say in the transverse direction of the mould corresponding to the thickness of the moulded product.

The closing of the other faces of the cavity of the mould, of substantially parallelepipedal form, is provided by spacers inserted between the two lateral walls which are clamped between these spacers during casting and cooling of the metal introduced into the mould.

The width of the spacers in the transverse direction determines the thickness of the flat product being cast.

A first spacer, or lower spacer, is fixed to the upper part of the support and tilting frame, practically over the entire length of this frame corresponding to the maximum length of the slab which can be cast in the mould.

A second spacer, or upper spacer, is held by suspension devices at a certain height and in a parallel position, above the lower spacer The position of the upper spacer determines the width of the slab cast in the mould. This upper spacer comprises a part which is bent at 90° at its front end, that is to say located towards the part of the mould placed above the casting vessel.

The front spacer is fixed to the front of the mould in an arrangement which is perpendicular to the lower and upper spacers, in the vicinity of their front ends. The lower end of the front spacer is disposed slightly in front of the front end of the lower spacer, the spout for filling the mould being located such that the passage orifice communicates with the space remaining between these two spacers. The front spacer is extended upwards so as to form, with the head of the upper spacer oriented at 90° relative to this spacer, a space communicating with the upper part of the mould providing filling of the header at the end of casting.

The fourth spacer disposed at the rear of the mould, the length of which corresponds to the width of the slab, is inserted between the upper spacer and the lower spacer and can be displaced between these two spacers so as to regulate the length of the slab cast.

In the casting position, the mould is tilted such that its front part lowers in the direction of the casting ladle, so as to form the connection between the filling spout and the exit orifice of the casting ladle.

The closing of the cavity of the mould is provided by applying a transverse clamping force on each of the lateral walls which comes into contact with the assembly of the spacers which are positioned in advance by means of suitable support or suspension devices.

The lateral walls consist of a metallic support on which the graphite blocks forming the inner moulding face of the wall are fixed.

The transverse forces being applied between the two lateral walls, at each of their points, during filling of the mould and during solidification of the metal, are essentially variable so that it is necessary to have available clamping means which have a certain flexibility and permit a certain adaptation of the forces applied in the different zones of the lateral walls. The walls must, in particular, absorb the differences in pressure of the metal and the differential expansions of the various zones of the spacers.

Moreover, clamping the lateral walls against the spacers must be performed efficiently throughout the casting operation in order to avoid leakages of metal and in order to ensure perfect product quality.

The mould must also comprise means for displacement of the lateral walls in the transverse direction, in one direction or in the other, so as to ensure the closing or the opening of the mould.

It has been proposed to connect the lateral walls, on the side of their outer face consisting of the support for the graphite blocks, to extremely rigid longitudinal structure elements consisting of beams whose length is greater than the length of the lateral walls of the mould. The lateral walls are connected to the beams by means of joining means which have a certain elasticity and consist, for example, of rods bearing on springs disposed at several points on the surface of the lateral walls. These elastic joining means make it possible to absorb the differences between the transverse stresses undergone by the walls and the differential expansions.

The clamping of the lateral walls is ensured by devices such as screw jacks inserted between the opposite ends of the beams located on either side of the longitudinal ends of the lateral walls The beams placed parallel to one another and on either side of the lateral walls, in the transverse direction form, with the screw jacks, a clamping frame which transmits transverse clamping forces to the lateral walls by means of the elastic joining devices.

The beams, whose length must be substantially greater than the length of the walls of the mould, are very long (for example, 14 meters) and the points for application of the stresses of the screw jacks are located at their ends so that these beams undergo an extremely high bending moment during clamping.

In order for clamping to be effective, it is therefore necessary for the beams to have very high rigidity and a very large moment of inertia, so these beams form elements of considerable size and mass.

Moreover, in order to open and close the mould, the beams which are mounted so as to move in the transverse direction on the frame of the mould must comprise means permitting their transverse displacement in one direction and in the other in a totally independent manner.

This design thus leads to an extremely heavy, complicated and costly structure.

In order to lighten and simplify the structure of the mould, it has been proposed for example in the LU-A-49077 to apply the transverse clamping forces of the walls directly on the supports of the graphite blocks forming the outer part of the lateral walls and to exert these transverse clamping forces by means of hydraulic jacks which can also provide the transverse displacement of the walls for opening and closing the mould.

However, this solution requires the use of a very large number of jacks disposed along the lower edge of the lateral wall and inserted between the frame of the mould and this wall as well as a very large number of jacks disposed on the upper part of the lateral walls and ensuring the join between these walls.

The assembly of jacks is fed in parallel via a hydraulic circuit, each of the jacks being connected to the circuit by means of a valve.

During clamping and operation of the installation, each of the jacks is, in fact, subjected to a pressure which depends on the transverse stresses on the wall in the zone where it is fixed. These transverse forces depend, in particular, on the expansion of the graphite wall and on the structure of the mould.

The pressure in each of the jacks depends on the load conditions of this jack and cannot be controlled. The individual valves are thus likely to open one after the other, the stresses at the level of the jack or jacks whose valve is open being distributed over the other jacks whose valves open in turn sequentially. This situation gives rise to "burst" opening of the clamping device.

This device for clamping and displacing the lateral walls by means of hydraulic jacks has the drawback of being extremely complicated due to the fact that a large number of jacks is required and that the feed and control of these jacks involves the presence of numerous hydraulic pipes and numerous valves fixed on various parts of the mould. There is also a risk of a leakage of hydraulic fluid and a risk of pollution by these fluids in the casting zone and the complexity of the installation creates problems which are very difficult to solve during maintenance of this installation.

Moreover, as was explained hereinabove, this complexity is not offset by the operation of the installation being both very reliable and very uniform, in particular on opening.

Moreover, in such an installation, the mechanisms for displacing and clamping the walls consist of the same elements, which somewhat simplifies the opening and closing operations of the mould.

The mould also has a lighter structure than when extremely rigid beams connected at their ends via screw jacks are used for clamping. However, it must be noted that, when only two clamping devices are used, good isostatic clamping is obtained in a satisfactory and simple manner. This condition is not complied with when a very large number of clamping jacks is used.

Moreover, although the overall structure of the mould is considerably lightened, in the case of clamping via the hydraulic jacks being applied directly to the lateral walls the support of the graphite blocks of these walls must be somewhat reinforced compared with the corresponding support of the walls which are fixed elastically on rigid beams.

SUMMARY OF THE INVENTION

The invention thus aims to propose a mould for pressure casting flat metal products of great thickness, such as slabs, comprising a frame for supporting and tilting the mould, two parallel lateral walls, intended to come into contact, via their inner opposite faces, with the cast metal, in order to form the faces of the slab, and mounted so as to be movable on the frame in the transverse direction perpendicular to their moulding faces and associated with means for displacement and clamping in the transverse direction, as well as spacers inserted between the lateral walls in order to delimit the space in which the product is cast, against which the lateral faces are clamped, the lateral faces consisting of graphite blocks of great thickness which are juxtaposed and fixed in a support and connected, by means of elastic joining means, for their displacement and for their clamping, to rigid beams disposed substantially over the entire length of the lateral walls and mounted so as to be movable transversely relative to the frame, this casting mould having a relatively simple and light structure, comprising means which perform both the transverse displacement and the clamping of the lateral walls, which is very efficient and very simple in operation and which ensures isostatic clamping and a restriction of the clamping stresses inside the structure elements of the frame of the mould.

To this end, the frame of the mould comprises at least one rigid transverse structure element disposed in a zone which is distant from the longitudinal ends of the frame, comprising two end bearing parts between which are disposed the support beams of the lateral moulding walls and the means for transverse displacement and clamping of the walls consist, for each of the walls, of at least one dual-action hydraulic jack carried by an end bearing part of the transverse element of the frame whose movable part is connected to the beam of the corresponding moulding wall in a zone which is distant from the longitudinal ends of the beam so as to perform, by virtue of the jacks, both the displacement of the moulding walls in order to bring them closer together or to separate them and the clamping of these walls against the spacers, during moulding, with the beams having as small a bending moment as possible and with the clamping forces being restricted by means of the transverse structure element of the frame of the mould.

BRIEF DESCRIPTION OF THE DRAWINGS

In order to make the invention easily understood, a description will now be given by way of non-limiting examples, with reference to the appended figures, of several embodiments of a mould for casting slabs according to the invention.

FIG. 2 is a perspective view of part of a lateral wall of the mould and of the spacers which come into contact with this wall.

FIG. 4 is a sectional view through a vertical plane along 4—4 in FIG. 5, showing the two lateral walls of a mould, one of these walls being in a closed position and the other wall in an open position.

FIG. 5 is a plan view according to 5 in FIG. 4.

FIG. 7 is a view, on a larger scale, of the detail 7 in FIG. 6A, with partial section.

BRIEF DESCRIPTION OF THE PREFERRED EMBODIMENTS

Figure 1:
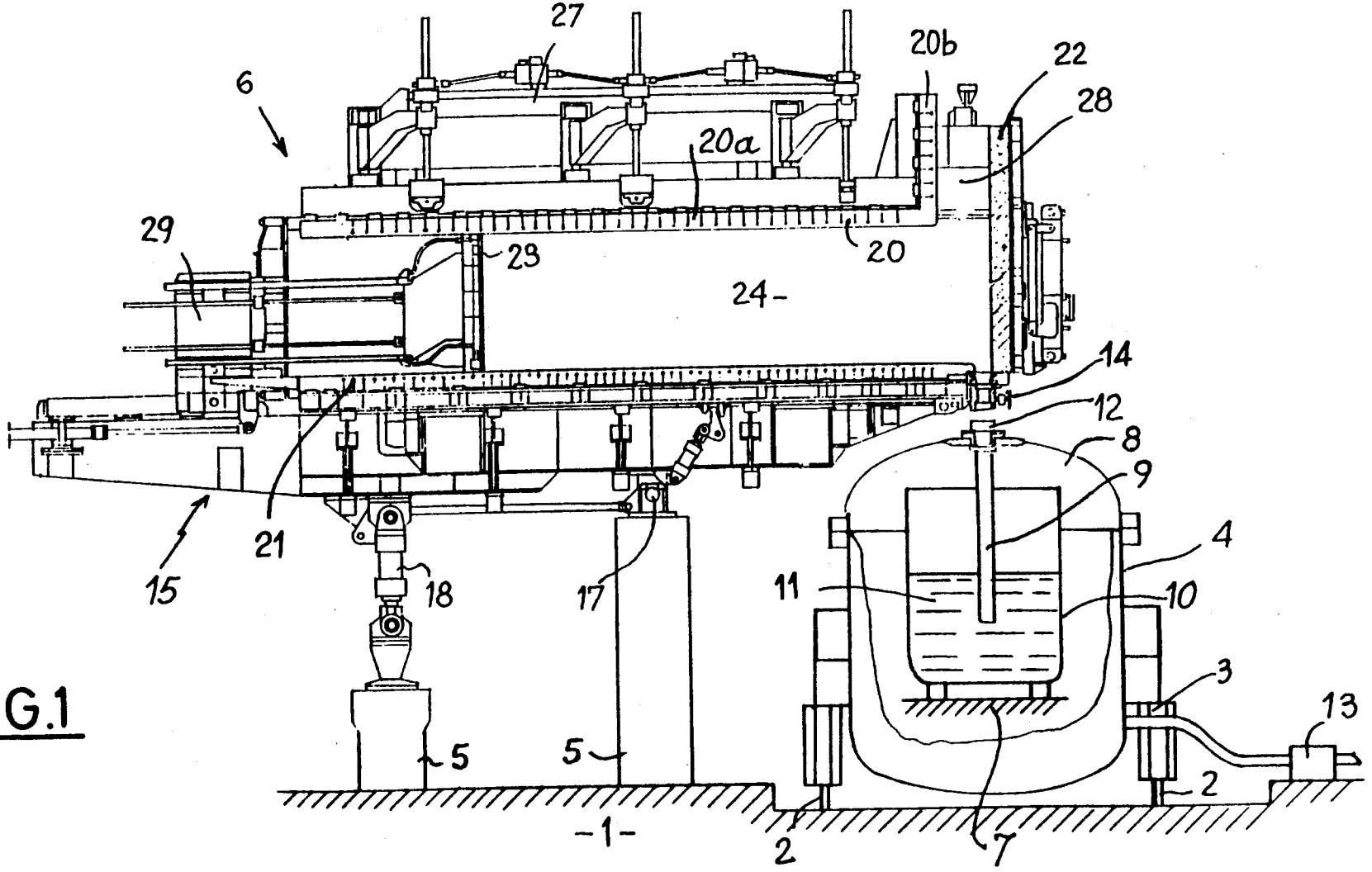
FIG. 1 is a diagrammatic view in elevation and in partial section of the assembly of an installation for pressure casting of slabs.

FIG. 1 shows the assembly of a pressure-casting installation which comprises, fixed on the ground 1 of the steel works, travel rails 2 for a carriage 3 providing the support and the displacement of a vessel 4 as well as columns 5 of a support of a mould 6 for the casting and the moulding of slabs.

The vessel 4 comprises a ladle support 7 and a closing cover 8 attached to a tube 9 in refractory material disposed substantially vertically when the cover 8 is in a closed position on the body of the vessel 4. A ladle 10 containing the molten steel 11 rests on the support 7 inside the vessel 4. The tube 9 in refractory material is immersed in the molten metal 11, its open lower end being located slightly above the bottom of the ladle 10. The upper end of the tube 9 passes through the cover 8 at the level of a device 12 which makes it possible to ensure the leaktight join between the opening for filling the mould 6 and the tube 9.

An installation 13 makes it possible to convey, inside the ladle 4, air at a pressure between 1 and 8 bars approximately and which can be regulated extremely precisely during casting.

FIG. 1 shows the mould 6 in its raised position. The inclined position of the mould 6 permits casting of the molten steel 11. In this position, a spout 14 for filling the mould, equipped with a closing slide, is applied in a leaktight manner against the device 12 located on the upper end of the cover 8 of the vessel 4 at the level of the through passage of the upper end of the tube 9.

The spout 14 for filling the mould 6 is located at the lowest part of the mould whose frame 15 may be slightly inclined relative to the horizontal plane. The longitudinal end of the mould located above the vessel 4 will be denoted as the front part of the mould.

The frame 15 of the mould supports the structure elements of this mould which will be described hereinbelow and tilts this mould between its inclined casting position and a withdrawn horizontal position in which the casting spout 14 is distant from the device 12 fixed on the vessel cover 8. In the withdrawn, or raised position, of the mould, for example at the end of casting a slab, the vessel 4 may be displaced by virtue of its carriage 3 in order to be brought into a casting position under a new mould or in a zone of the steel works permitting the replacement of the ladle 10 by a new ladle filled with steel, inside the vessel 4.

In order to tilt the mould 6, the frame 15 is mounted in an articulated manner about a horizontal shaft 17 on one of the support columns 5.

A jack 18 is inserted between a second column 5 and a part of the frame 15 disposed according to the length of the mould, towards the rear relative to the articulation shaft 17.

A description will now be given, with reference to FIGS. 1 and 2, of the general structure of the mould whose cavity is delimited on four faces corresponding to the thickness of the slab by spacers 20, 21, 22 and 23, which can be seen in FIG. 1, and over its two lateral faces corresponding to the two large faces of the slab by lateral walls such as the wall 25 whose front part is visible in FIG. 2. The inner cavity 24 of the mould is filled progressively with molten steel 11 when the compressed air is conveyed via the installation 3 to the inside of the ladle 4, this molten metal passing into the tube 9 in refractory material and penetrating inside the mould via the filling spout 12. As the mould is inclined forwards, the layer of metal cast in the mould has a height which decreases from the front towards the rear of the mould.

The upper spacer 20, fixed to a suspension device 27, comprises a longitudinal part 20*a* intended to delimit the upper edge of the slab and a front part 20*b*, disposed at 90° relative to the longitudinal part 20*a* and directed upwards. The front spacer 22 comprises an upper part disposed opposite the front part 20*b* of the upper spacer 20, delimiting therewith a riser 28 in which the cast metal 11 penetrates at the end of casting when the metal fills the highest part of the mould at its rear end. The riser 28 places the cavity of the mould in communication with a header in which shrinkage takes place.

The lower spacer 21 is supported by the frame 15 and disposed according to its longitudinal direction corresponding to the longitudinal direction of the cast slab.

The rear spacer 23 is connected to a longitudinal displacement device 29 carried by the rear part of the frame 15. The spacer 23 is inserted between the upper spacer 20 and the lower spacer 21 and determines the width of the slab. The spacers 20, 21, 22 and 23 all have the same thickness and make it possible to fix the width of the moulding cavity corresponding to the thickness of the slab.

As may be seen in FIG. 2, the lateral walls 25 of the mould 6 which are applied against the spacers such as 20, 21, 22 (only the front part of the lateral wall 25 has been shown in FIG. 2), comprise a support 30 and an inner lining 31 consisting of graphite blocks of great thickness fixed in the support 30 whose C-shaped cross-section provides a housing for the blocks 31. The perfectly plane inner face 32 of the blocks 31 comes into contact with the spacers, on either side of the latter, in order to provide, with these spacers, the cavity for casting the slab. The faces 32 which come into contact with the molten metal which progressively fills the mould thus form a moulding surface for the large faces of the slab.

The front end of the lower spacer 21 has a rounded form and a cutout and provides a passage space for the metal in the cavity of the mould with the lower part of the front spacer 22. The filling spout 24 of the mould is located in the extension of this passage space for the molten metal.

FIG. 2 also shows that the riser 28 is delimited laterally by part of the inner surfaces 32 of the graphite blocks of the walls 25.

The graphite blocks 31 forming the lining for the lateral walls 25 are perforated with channels 33 disposed substantially at an equal distance from one another according to the length of the mould. The channels 33 make it possible to receive devices for cooling the graphite blocks by spraying water.

The walls 25 disposed on either side of the spacers 20 are mounted so as to be movable in the transverse direction on the frame 15 of the mould, that is to say in the direction perpendicular to their moulding face 32 corresponding to the direction of the thickness of the spacers and of the cavity for casting the slab.

Means for support, guiding and displacement in the transverse direction and clamping means which will be described with reference to FIGS. 3 to 7 are associated with each of the walls 25.

Figure 3:
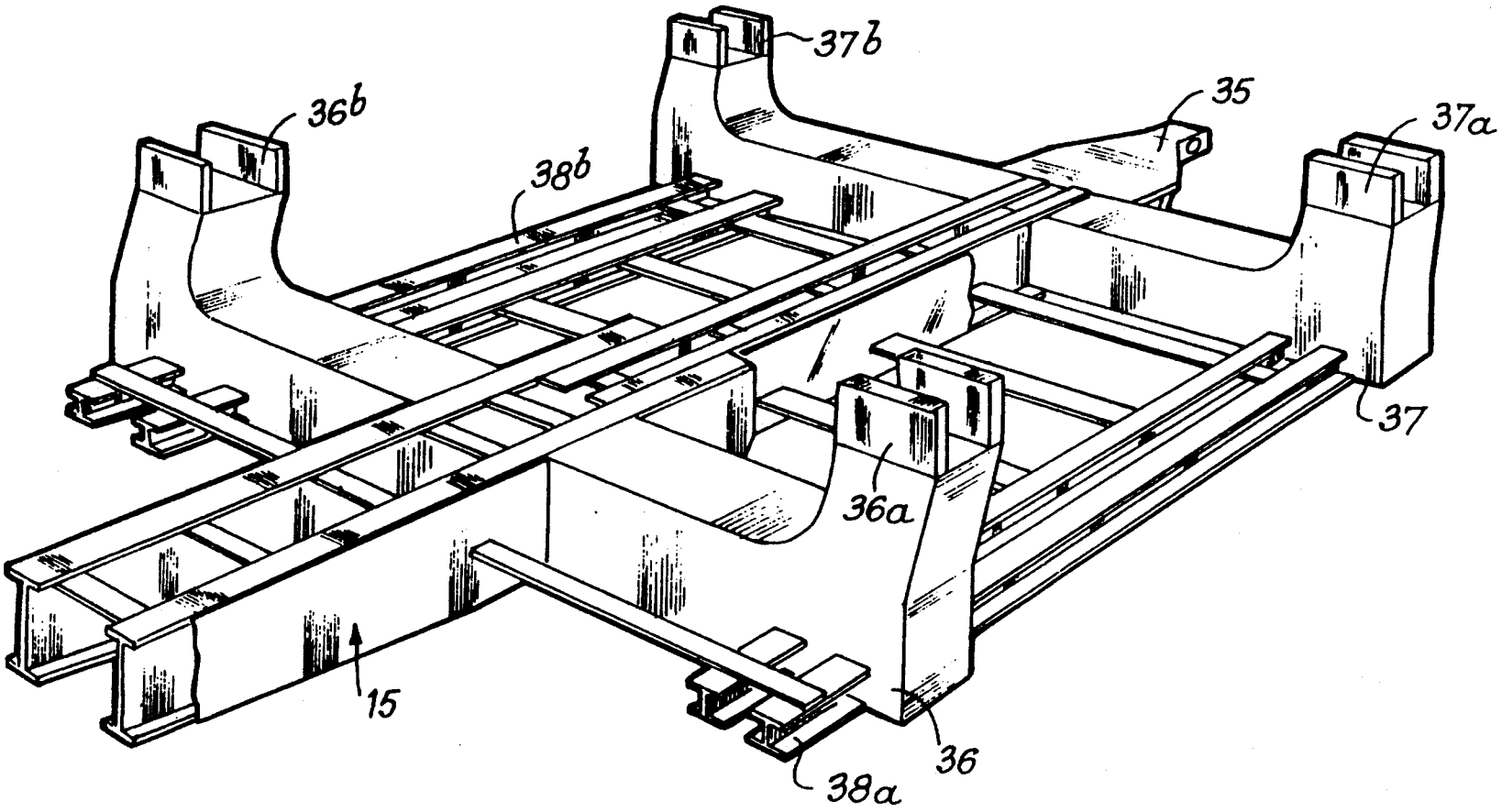
FIG. 3 is a perspective view of the support and tilting frame of the mould according to the invention.

FIG. 3 shows the frame 15 of the mould whose form and structure permit the mounting and implementation of a device for displacement and clamping of the lateral walls 25 which does not have the drawbacks of the devices according to the prior art which have been described hereinabove.

FIG. 3 shows the frame 15 of the mould which comprises a longitudinal member 35 whose upper surface makes it possible to receive the lower spacer 21 of the mould. The longitudinal member 35 consists of small beams and metal sheets cut out and assembled by welding and giving the structure great rigidity. The upper part of the longitudinal member 35 which receives the spacer has bearing surfaces whose position is regulated extremely precisely in order to correctly position the lower spacer disposed according to the length of the mould and which delimits its lower wall.

According to the invention, the frame 15 comprises two transverse structure elements 36 and 37 in the form of a C or of a U, whose ends 36*a*, 36*b*, 37*a*, 37*b*, directed upwards, form the supports for the means for displacing and clamping the lateral walls 25 of the mould.

The bearing parts 36*a*, 36*b*, 37*a*, 37*b* are connected to their lower part on bearing longitudinal members 38*a*, 38*b* which are parallel to the central longitudinal member 35 of the frame 15. The bearing longitudinal members 38*a* and 38*b* make it possible to improve the rigidity of the assembly of the frame and to provide bearing surfaces which make it possible to improve the stability of the mould which rests in a casting position on bearing columns located laterally at the level of the longitudinal members 38*a* and 38*b*.

The transverse elements 36 and 37 are formed in the same manner as the central longitudinal member 35, by welding of metal sheets, and also have great rigidity which enables them to form structure elements supporting the clamping stresses of the mould.

The C-shaped transverse elements 36 and 37 are fixed on the central longitudinal member 35 in zones which are substantially distant from the ends of this longitudinal member 35.

In fact, in the embodiment of the invention described and shown, the element 36 is located at a distance from the rear end of the longitudinal member 35 which is substantially greater than the distance separating the front element 37 from the front end of the longitudinal member 35.

As may be seen in FIG. 1, the rear part of the frame 15 receives the device 29 for longitudinal displacement of the rear spacer 23 whilst the front spacer 22 of the mould is located at the level of or very slightly in front of the front part of the frame 15. The overall mould and, in particular, its lateral walls 25, is thus offset forwards relative to the position of the longitudinal member 35, in the case of the embodiment described.

The position of the C-shaped structure elements 36 and 37 is thus chosen so that the bearing parts 36*a*, 36*b*, 37*a*, 37*b*, located at the end of these elements, are located, in the longitudinal direction, at the level of zones of the lateral walls 25 which are substantially distant from their ends.

The overall frame shown in FIG. 3 forms a cradle which makes it possible to support and guide the lateral walls 25 in the transverse direction as well as withstand and compensate for stresses of the devices for the displacement and clamping of these lateral walls.

FIGS. 4 and 5 show that the lateral walls 25 are connected by means of the support 30 of the graphite blocks 31 to longitudinal beams 40 disposed laterally and opposite according to the length of the frame 15 so that the walls 25 are in positions which are parallel to one another.

The beams 40 are fixed at their lower part on carriages 41 comprising rollers 42 which can be displaced by rolling in the transverse direction on tracks consisting of a bearing rail 43 and an upper support plate 44 fixed on the inner part of the structure element such as 37 in its transverse rectilinear part.

Although a description is given only of the support, guiding, displacement and clamping means associated with the transverse structure element 37, it is quite obvious that the element 36 comprises equivalent means, as is apparent from FIG. 5.

The means for displacement and clamping of the walls 25 consist of four hydraulic jacks 45 each fixed on a bearing part 36*a*, 36*b*, 37*a*, 37*b* forming an upper bearing end of one of the C-shaped transverse structure elements 36 or 37. These end and bearing parts of the elements 36 and 37 have the form of covers in each of which the body of a jack 45 is fixed. Each of the rods 45' of the jacks 45 is connected to the corresponding beam 40 at the level of the transverse structure element 36 or 37.

As may be seen in FIG. 5, the beams 40 have a length which is slightly less than the length of the supports 30 of the walls 25.

The supports 30 of the walls 25 are connected to the beams 40 at a certain number of points by means of joining devices 46 which will be described in greater detail hereinafter, with reference to FIGS. 6A and 6B.

The transverse structure elements 36 and 37 are located in zones of the walls 25 which are substantially distant from their ends. The rods of the jacks 45 are thus connected to the beams 40 in zones which are themselves distant from the longitudinal ends of these beams.

In the embodiment shown in FIG. 5, the distance between the joining point of the rod 45' of a jack 45 and the longitudinal end of the closest beam 40 is substantially equal to 25% of the total length of the beam.

It is thus quite obvious that, relative to the arrangement of the prior art which uses beams which are clamped at their ends by screw jacks, on the one hand the total length of the beams relative to the length of the lateral walls of the mould is reduced and, on the other hand, the point of application of the clamping stresses on these beams is in a zone which makes it possible to make the bending moment of the beam as small as possible when the lateral walls are clamped against the spacers.

The end parts 36*a* and 37*a* of the transverse structure elements 36 and 37 located towards the outside of one of the beams 40 on one of the lateral sides of the mould carry a first torsion bar 48*a* disposed between these end parts 36*a* and 37*a* in a parallel arrangement to the beam 40 and to the corresponding wall 25, that is to say in a longitudinal direction.

Similarly, a torsion bar 48*b* is carried at its ends by an outer end part 36*b* and 37*b* of the transverse structure elements 36 and 37 and placed in a longitudinal direction parallel to the beam 40 and to the corresponding lateral wall 25.

At each of the ends of the torsion bars 48*a* and 48*b*, an assembly of two articulated connecting rods makes it possible to connect the torsion bar to the beam 40.

Each of the assemblies comprises a first lever 50 fixed rigidly on the corresponding torsion bar 48 and connected in an articulated manner, at its other end, to a connecting rod 51 articulated at the end of the lever 50, on the one hand, by means of the shaft 52*a* and on the beam 40, on the other hand, by means of the shaft 52*b*. The articulation of the assembly of the levers 50 and of the connecting rod 51 about the shaft (sic) 48*a*, 52, 52*a* and 52*b* makes it possible for the lever 50 to rotate about the articulation 48*a* when the jacks 45 displace the beam 40 and the corresponding wall 25 between its completely open position, shown on the left in FIG. 4, and its closed position shown on the right in FIG. 4. This displacement is obtained by withdrawal of the rods 45' of the jacks 45 connected to the corresponding beam 40 in the joining zones of this beam located at a distance from one another which is approximately equal to 50% of the total length of the beam 40.

During this displacement, the two connecting rods 50 fixed rigidly to the ends of the torsion bar 48 rotate by an angle which is absolutely identical if the two jacks 45 associated with the corresponding beam 40 displace this beam so that it is perfectly parallel to the theoretical longitudinal direction of the mould.

When the jacks 45 are fed at low pressure and displace the corresponding beam 40 and wall 25, for example in order to bring the wall into its closing position, the corresponding torsion bar 48 has sufficient rigidity to not suffer any significant torsion and to ensure that the beam 40 is perfectly parallel to the theoretical longitudinal direction of the mould.

Moreover, when the inner faces of the lateral walls 25 enter into contact with the spacers, the hydraulic jacks 45 are fed at high pressure in order to clamp the lateral walls of the mould, by means of the beams 40 and the elastic joining devices 46, between the beams 40 and the supports 30 of the corresponding lateral walls 25.

This clamping stress by feeding the jacks 45 at high pressure is exerted during the last part of the displacement of the lateral walls over a distance of the order of 25 mm and is maintained throughout the operation of casting and cooling the slab, before it is removed from the mould.

The stresses exerted on the beam 40 by the jacks 45 fed at high pressure are capable of causing a certain torsion of the bars 48 which results in the absorption of a certain misalignment of the beams 40 relative to their theoretical longitudinal direction while ensuring an equal distribution of the clamping stresses of the jacks on each side of the mould and for each of the faces.

This ensures a displacement of the walls such that these walls remain strictly parallel to their theoretical direction while permitting a homogeneous distribution of the clamping stress during casting.

When opening the mould, in the case where the bars 48 have born a certain torsion during the clamping operation, the elastic return of the bars to their original state allows the walls to be replaced in their parallel disposition and in their theoretical direction.

Figures 6A, 6B:
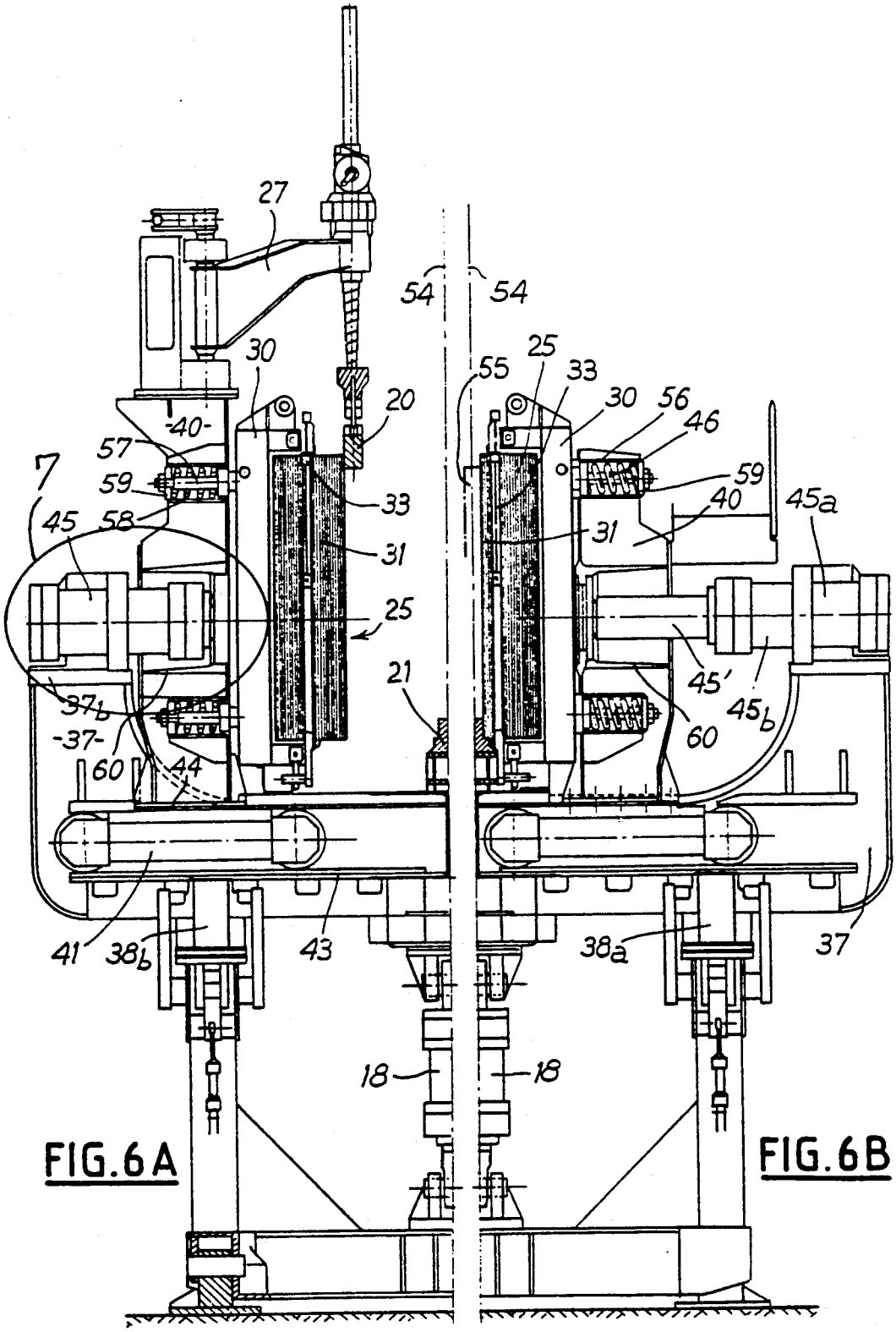
FIG. 6A is a half-view in section through a vertical plane of the mould according to the invention, the corresponding lateral wall of which is in an open position.
FIG. 6B is a half-view in section through a vertical plane of the mould according to the invention, the corresponding lateral wall of which is in a closed position and in its state of maximum wear.

FIGS. 6A and 6B show, in more detail, the structure of the displacement and clamping device shown diagrammatically in FIG. 4.

In FIG. 6A, the lateral wall 25 has been shown in its completely open position, the corresponding support beam 40 being in its most distant lateral position towards the outside of the axis 54 of the mould. This position corresponds to the complete opening of a new lateral wall, the thickness of the graphite blocks 31 of which is at its maximum.

On the other hand, FIG. 6B shows a wall 25 in its closing position, the corresponding support beam 40 being in its closest lateral position to the axis 54 of the casting mould. The rod 45' of the jack 45 is then withdrawn to its maximum extent.

This position corresponds to the closing position of a lateral wall 25 whose inner layer of graphite blocks 31 has reached its point of maximum wear.

During the successive castings of slabs, the graphite blocks 31 undergo a certain wear, and their moulding surfaces can be repaired up to such time as the thickness of graphite remaining beyond the cooling channels 33 reaches a limit value.

In FIG. 6B, the lateral wall 25 has been shown in its clamping position against the lower spacer 21. Broken lines show the cross-section 55 of the moulding cavity corresponding to the transverse section of the slab being cast.

FIG. 6A also shows the device 27 for suspension and positioning of the upper spacer 20 which, in the case of the installation shown, is carried by the upper part of the beam 40.

As may be seen in FIG. 6A and 6B, the walls 25 are connected to the corresponding beams 40 by means of their support 30 and elastic devices 46 placed inside housings 56 provided in the beam 40.

Each of the devices 46, of conventional design, comprises a rod 57 bearing on the outer face of the support 30 of the corresponding wall 25 and disposed according to the axis of a housing 56 of the beam 40. A helical spring 58 is disposed coaxially around the rod 57, inside the housing 56. The spring 58 is inserted between a bearing surface of the rod 57 and an angular bearing plate 59 which the rod 57 passes through, the threaded end of the latter receiving a locking and regulating nut.

This forms an elastic join between the beam 40 and the corresponding wall 25, the clamping forces exerted on the beam 40 by means of the jacks 45 being transmitted to the walls 25 by means of the elastic devices 46. This automatically adapts the clamping stresses in the different zones of the lateral wall according to the expansions undergone by this wall and the structure of the mould.

In the extension of the jacks 45, the beams 40 comprise housings 60, in each of which a part of the body of the corresponding jack 45 can penetrate in its position of maximum withdrawal, as shown in FIG. 6A.

This possibility and the arrangement of the thrust and traction elements of the jack 45, which will be described with reference to FIG. 7, make it possible to reduce the overall size of the device for displacement and clamping of the lateral walls in the transverse direction.

As may be seen in FIGS. 6A, 6B and 7, the body of the jack 45 comprises a part **45*a* located towards the outside of the mould and fixed on the corresponding end part 37*a* or 37*b* of the corresponding transverse element 37 as well as a part 45*b* directed towards the inside of the mould and capable of penetrating, in the position of complete withdrawal of the jack, inside the corresponding housing 60 of the beam 40**.

As may be seen in FIG. 7, the jack is fed with hydraulic fluid by means of the part **45*a* of the body of the jack carried by the bearing end of the transverse element 37**.

The rod of the jack 62 comprises, at its front end directed towards the inside of the mould, a cavity 63 in which is mounted a thrust element 64 equipped with pivots 66 and 67 at its ends. The pivot 67 is received in a pivot bearing 68 attached to the rod 6.

The pivot 66 is received in a pivot bearing 69 attached to a plate 70 fixed on the beam 40 by means of an annular piece 71 and ensuring the join between the beam 40 and the jack 45.

A bore 65 passes axially through the thrust element 64 and in this bore is mounted a traction rod 72 comprising bearing stops 73 and 74 at its ends. The stop 73 is engaged on one end of the rod penetrating in an opening 75 of the joining plate 70 and the bearing stop 74 in a part of the cavity 63 closed by a bearing surface 76 of the rod 62.

It is apparent that the displacements of the rod 62 of the jack 45 are transmitted to the joining plate 70 attached to the beam 40, in the direction of the thrust, by means of the thrust element 64 mounted so as to pivot at its ends inside the rod 62 and against the plate 70.

The thrust necessary for clamping the mould is thus transmitted via the solid piece 64 whose pivoting mounting makes it possible to absorb any misalignments between the axis of the jack and the direction of displacement of the beam 40.

Moreover, in the direction of traction, that is to say of the withdrawal of the rod of the jack inside the body and of the displacement of the lateral wall associated with the beam 40 in the direction of opening, the traction is simply transmitted by means of the rod 72 whose stops 73 and 74 come into contact with the plate 70 and the stop piece 76 of the rod 62, respectively. The opening of the mould, which is not accompanied by major forces, can be transmitted via a rod with a diameter which is relatively small and with or without misalignment of the axis of traction relative to the axis of displacement of the wall not being clamped.

At the end of displacement of the wall in the direction of opening, as shown in FIG. 6A, the end **45*b* of the body of the jack 45 penetrates inside the opening 60 of the corresponding beam 40. This arrangement and the design of the thrust and traction rod which has been described hereinabove make it possible to minimise the overall size of the jack 45** in the transverse direction.

When applying the clamping stress to the lateral walls of the mould bearing via their inner face on the spacers, the stresses exerted by the jacks 45 fixed to the bearing end of the C-shaped transverse elements 36 and 37 are taken up by these elements which restrict the clamping stresses at the level of each of the pairs of jacks located opposite one another.

Moreover, as has been explained hereinabove, the arrangement of the jacks in the zones located according to the length of the beams 40 at positions which are distant from the ends of these beams makes it possible to minimise the bending moments undergone by the beams upon clamping. It is thus possible to considerably reduce the overall size and the weight of these beams and thus of the overall mould.

As in the known technique which uses beams clamped at their ends by screw jacks, good isostatic clamping is obtained and the joining via the elastic elements of the lateral walls to the corresponding beams makes it possible automatically to obtain good longitudinal distribution of the clamping stresses.

An additional advantage of the device according to the invention relates to optimization of the bending moments applied to the beams during clamping. It thus becomes possible to considerably reduce the overall mass of the mould, particularly by lightening the structure of the beams.

Moreover, the frames cf the lateral walls located opposite one another remain totally independent of one another during their displacement, no clamping or displacement means, such as jacks, being inserted between these frames.

The device thus presents the advantage of requiring only one mechanism to displace and clamp the lateral walls of the mould.

The stresses exerted on the lateral walls during clamping may be synchronized in a simple manner by virtue of the hydraulic control of the jacks. Clamping and unclamping of the mould is also perfectly controlled since these are achieved by virtue of a small number of jacks applying stresses on the beams to which the lateral walls are connected by means of elastic devices for adapting the stresses If use is made of a torsion-bar device as described, perfect synchronization of the displacements of the frames, on closing and on opening, is obtained in a very simple and very effective manner.

Figure 8:
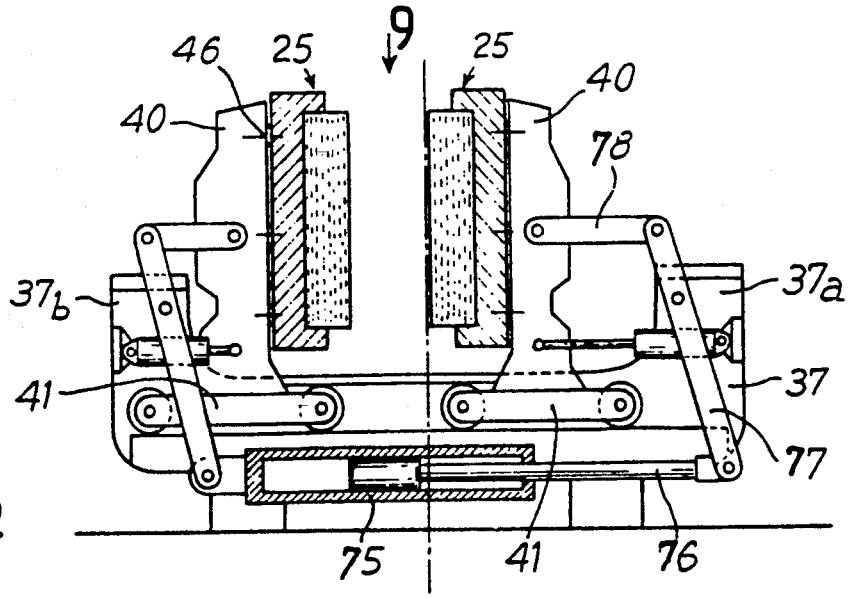
FIG. 8 is a diagrammatic sectional view through 8—8 in FIG. 9 of the lateral walls of a mould according to the invention and according to an alternative embodiment.
Figure 9:
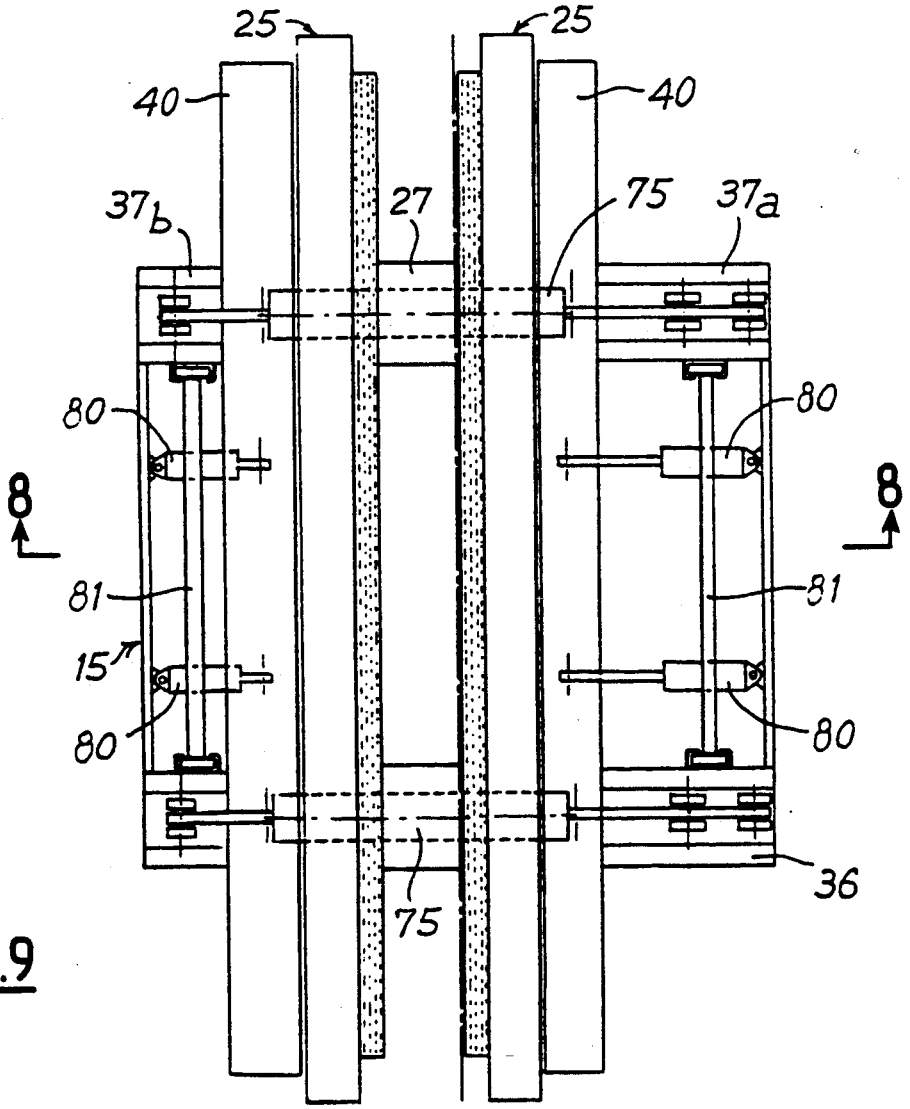
FIG. 9 is a plan view according to 9 in FIG. 8.

FIGS. 8 and 9 show diagrammatically an alternative embodiment of the pressure-casting mould according to the invention.

The corresponding elements in FIGS. 8 and 9, on the one hand, and in FIGS. 4 and 5, on the other hand, bear the same references.

The frame for supporting and tilting the mould is substantially identical to the frame shown in FIG. 3 which comprises two C-shaped transverse elements 36 and 37.

As above, the lateral walls 25 of the mould are fixed on beams 40 by means of elastic devices 46, and the beams 40 are mounted so as to be movable in the transverse direction on elements 37 of the frame, by means of carriages 41.

However, in the alternative embodiment shown in FIGS. 8 and 9, clamping of the walls 25 by means of the beams 40 is performed by two hydraulic jacks 75 instead of four hydraulic jacks 45 as in the embodiment shown in FIGS. 4 and 5.

The jacks 75 are disposed in the lower part of the frame of the installation, beneath the C-shaped transverse structure elements 36 and 37.

The jacks 75 comprise two actuating rods 76 which are each connected in an articulated manner to a lever 77 mounted so as to pivot on a horizontal shaft at the level of the bearing end 37*a* of the C-shaped transverse element 37.

The end of the lever 77 opposite the rod 76 of the jack 75 is connected in an articulated manner to a thrust rod 78 fixed to the corresponding beam 40.

The feed of the jack 75 in the direction of withdrawal of the rods 76 produces a displacement of the walls 25 towards one another and thus a clamping effect.

Unlike the embodiment shown in FIGS. 4 and 5, the displacement of the beams 40 and thus of the walls 25 which are connected thereto, by means of the jacks 75, are not independent of one another.

It is thus necessary to provide, for the independent displacement of the walls relative to one another, additional displacement jacks 80 inserted between a part of the frame 15 of the mould and the corresponding beams.

Torsion bars 81 make is possible to synchronize the displacement of the two jacks 80 and to keep the beam 40 parallel.

After closing the mould, clamping may be provided by the jacks 75; this two-jack device has the same advantages as the four-jack device described with reference to FIGS. 4 and 5, except for the fact that it is necessary, in this case, to provide independent jacks for the displacement of the walls and for their clamping.

The invention is not limited to the embodiments which have been described.

Thus it is possible to design a mould whose frame comprises only one C- or U-shaped transverse structure element disposed in the vicinity of the central part of the frame.

In this case, it is possible to use only one displacement and clamping jack for each of the walls, the stresses of which will be applied in the vicinity of the centre of the lateral wall. This arrangement is, however, markedly less favourable than the arrangement described with respect to minimising the bending moment of the beams to which the walls are connected. However, this arrangement is still preferable with respect to minimising the bending moment to the arrangement according to the prior art in which the clamping means were inserted between the ends of the beams outside the longitudinal ends of the mould.

It is quite obvious that the transverse structure element may have a form other than that of a C or of a U since this transverse element makes it possible to provide bearing surfaces for the thrust means, such as jacks, on each of the lateral sides of the frame of the mould.

In all cases, these transverse structure elements comprising lateral bearing surfaces must be disposed in the longitudinal direction so that the thrust means associated with the supports can exert transverse forces on the lateral walls of the mould in zones which are relatively distant from the ends of these walls.

In practice, these supports will be located outside the end parts of the lateral walls whose length represents approximately at least 20% of the total length of the lateral walls.

This embodiment is represented by the arrangement in the lateral walls of the mould of at least one or two jacks in a central zone of this wall representing no more than 60% of the total length of the lateral wall.

It is quite obvious that the jacks may be mounted in a different manner from that which has been described and which has the advantage of reducing the total transverse size of each of the thrust and traction jacks.

Similarly, the devices for synchronizing the displacements of the walls can be produced in a different form from the torsion bars which have been described.

Finally, the mould according to the invention may be used for the pressure casting of any flat product, such as a slab, regardless of the dimensions of this product, as regards both its length and its width and its thickness.

We claim:

1. A mould for pressure casting flat metal products or great thickness and considerable length comprising:

a frame for supporting and tilting the mould;

two parallel lateral walls intended to come into contact, on inner opposite moulding faces, with cast metal to form faces of a slab, said lateral walls are mounted so as to be movable on the frame in transverse directions perpendicular to the moulding faces;

means for displacing and clamping said lateral walls in the transverse direction;

spacers between the lateral walls for establishing a space in which the slab is cast, against which the lateral walls are clamped, rigid support beams disposed substantially over the entire length of the lateral walls and mounted so as to be movable transversely relative to the frame, elastic joining means for displacing and clamping said lateral walls to said support beams, the frame of the mould comprising at least one rigid transverse structure element disposed in a zone which is substantially distant from longitudinal ends of the frame, said structure element comprising two end bearing parts between which are disposed the support beams of the lateral moulding walls; and means for transverse displacement and clamping of each of the walls including at least one dual-action jack carried by an end bearing part of the transverse structure element of the frame connected to the support beam of the corresponding lateral wall in a zone substantially distant from the longitudinal ends of said support beam so as to perform, solely by virtue of the at least one dual-action jack, both displacement of the lateral walls, and clamping of the lateral walls against the spacers.

2. Casting mould according to claim 1, wherein the support frame of the mould comprises: a longitudinal member disposed in a longitudinal direction of the mould; and two transverse structure elements whose end bearing surfaces each carry a displacement and clamping jack.

3. Casting mould according to claim 1, wherein the transverse structure element or elements have the shape of a C or of a U comprising two branches whose ends form end bearing parts.

4. Casting mould according to claim 1, wherein the transverse structure element is placed in a central zone of the frame located opposite a central zone of the lateral walls of the mould, said central zone having a length which is substantially equal to 60% of the total length of the lateral walls.

5. Casting mould according to claim 2, wherein each of the transverse structure elements is located on the frame in a zone disposed opposite a zone of the lateral walls of the mould which is located at a distance from a closest longitudinal end of the wall equal to approximately 25% of the total length of the lateral wall.

6. A casting mould according to claim 1 wherein the elastic joining means between the support beams and the lateral walls comprises helical springs disposed in housings of the support beams and are inserted between the bearing surfaces on the support beams and a bearing piece on the lateral walls.

7. A casting mould according to claim 2, wherein torsion bars are placed in the longitudinal direction of the mould and on each lateral side of the mould between end bearing parts which are opposite one another, each of the support beams being connected to the torsion bar disposed on the same lateral side of the mould by two lever/connecting rod assemblies in the vicinity of the ends of the torsion bar, the levers and connecting rod being articulated together around a shaft of longitudinal direction, the lever being connected rigidly to the torsion bar and the connecting rod being articulated on the support beam so as to keep the support beam parallel during its displacement through the action of the at least one dual-action jack.

8. A casting mould according to claim 7, wherein the rigidity of the torsion bar is sufficient to keep the support beams parallel during their displacement when the jacks are fed at low pressure, and the torsion bar undergoing deformations only during clamping of the mould, wherein the jacks are fed at high pressure, in order to absorb any misalignment of the support beam while maintaining the clamping pressure of the jacks.

9. A casting mould according to claim 1 wherein:

each said at least one dual-action jack has a body which comprises a part projecting towards the inside relative to the end support part of the transverse structure element;

each said support beam comprises at least one housing in a position corresponding to the projecting part of a said jack for receiving said projection part of the body of the jack when a corresponding wall is opened.

10. A casting mould according to claim 1 wherein each said jack comprises a thrust and traction rod, inside of which is mounted a thrust element comprising a central bore in which is mounted a traction rod, a thrust of the jack being transmitted by the thrust element and withdrawal of the jack being performed by the traction rod mounted freely in the bore of the thrust element.

11. Casting mould according to claim 1 wherein the lateral walls consist of graphite blocks of great thickness which are juxtaposed and fixed in a support.

12. A casting mould according to claim 2, wherein the at least one transverse structure element has a shape of one of a C and a U comprising two branches whose ends form end bearing parts.

13. A casting mould according to claim 2, wherein the transverse structure element is in a central zone of the frame located opposite a central zone of the lateral walls of the mould, said central zone having a length which is substantially equal to 60% of the total length of the lateral walls.

14. Casting mould according to claim 2, wherein the elastic joining means between the support beams and the lateral walls comprises helical springs disposed in housings of the support beams and are disposed between the bearing surfaces on the support beams and a bearing piece on the lateral walls.

15. A casting mould according to claim 2 wherein:

the said at least one jack has a body which includes a part projecting towards the inside relative to the end support part of the transverse structure element; and each said support beam comprises at least one housing in a position corresponding to the projecting part of a said jack for receiving said projecting part of the body of the jack when a corresponding wall is opened.

16. Casting mould according to claim 2, wherein each said jack comprises a thrust and traction rod inside of which is mounted a thrust element comprising a central bore in which is mounted a traction rod, a thrust of the jack being transmitted by the thrust element and withdrawal of the jack being performed by the traction rod element freely in the bore of the thrust element.

17. Casting mould according to claim 2, wherein the lateral walls includes graphite blocks of great thickness which are juxtaposed and fixed in a support.

18. A mould for pressure casting flat metal products of great thickness and considerable length comprising:

a frame for supporting and tilting the mould;

two parallel lateral walls intended to come into contact, on inner opposite faces, with cast metal to form faces of a slab, said lateral walls being mounted so as to be movable on the frame in transverse directions perpendicular to the moulding faces;

means for displacing and clamping the lateral wall in the transverse direction;

spacers between the lateral walls for establishing a space in which the slab is cast, against which the lateral walls are clamped;

rigid support beams disposed substantially over the entire length of the lateral walls and mounted so as to be movable transversely relative to the frame, elastic joining means for displacing and clamping said lateral walls to said support beams.

the frame of the mould comprising at least one rigid transverse structure element disposed in a zone which is substantially distant from longitudinal ends of the frame, said structure element comprising two end bearing parts between which are disposed the support beams of the lateral moulding walls; and the means for clamping the walls including at least one jack disposed beneath a transverse structure element, of the frame said at least one jack comprising two rods which are each connected in an articulated manner to an end of a lever mounted so as to pivot on an end bearing part of the transverse structure element, an end of the lever opposite to the articulation on the rod of the jack being articulated on a rod connected to one of the support beams.

19. Casting mould according to claim 18, wherein the lateral walls includes graphite blocks of great thickness which are juxtaposed and fixed in a support.

* * * * *